United States Patent [19]

Fukuda et al.

[11] Patent Number: 4,818,656

[45] Date of Patent: Apr. 4, 1989

[54] IMAGE FORMING MEMBER FOR ELECTROPHOTOGRAPHY

[75] Inventors: Tadaji Fukuda, Kawasaki; Yutaka Hirai; Katsumi Nakagawa, both of Tokyo; Toshiyuki Komatsu, Yokohama, all of Japan

[73] Assignee: Canon Kabushiki Kaisha, Tokyo, Japan

[21] Appl. No.: 198,729

[22] Filed: May 24, 1988

Related U.S. Application Data

[63] Continuation of Ser. No. 102,791, Sep. 24, 1987, abandoned, which is a continuation of Ser. No. 939,283, Dec. 3, 1986, abandoned, which is a continuation of Ser. No. 840,975, Mar. 13, 1986, abandoned, which is a continuation of Ser. No. 749,117, Jun. 26, 1985, abandoned, which is a continuation of Ser. No. 647,869, Sep. 5, 1984, abandoned, which is a continuation of Ser. No. 571,147, Jan. 17, 1984, abandoned, which is a continuation of Ser. No. 367,024, Apr. 9, 1982, abandoned, which is a continuation of Ser. No. 199,266, Oct. 21, 1980, abandoned.

[30] Foreign Application Priority Data

Oct. 24, 1979 [JP] Japan ..... 54-137238

[51] Int. Cl.[4] ..... G03G 5/082; G03G 5/09

[52] U.S. Cl. ..... 430/65; 430/84; 430/85; 430/95

[58] Field of Search ..... 430/65, 84, 85, 95

[56] References Cited

U.S. PATENT DOCUMENTS

| | | | |
|---|---|---|---|
| 4,217,374 | 8/1980 | Ovshinsky et al. | 430/84 X |
| 4,225,222 | 10/1980 | Kempter | 430/95 X |
| 4,226,898 | 10/1980 | Ovshinsky et al. | 430/84 X |
| 4,265,991 | 5/1981 | Hirai et al. | 430/64 |
| 4,289,822 | 9/1981 | Shimada et al. | 427/74 X |

FOREIGN PATENT DOCUMENTS

| | | | |
|---|---|---|---|
| 2056013 | 5/1971 | Fed. Rep. of Germany | 430/85 |

*Primary Examiner*—Roland E. Martin

*Attorney, Agent, or Firm*—Fitzpatrick Cella, Harper & Scinto

[57] ABSTRACT

An electrophotographic image forming member comprises a substrate and a photoconductive layer overlying the substrate and composed of a hydrogenated amorphous silicon containing 0.001–1000 atomic ppm of carbon as an impurity based on silicon.

7 Claims, 1 Drawing Sheet

IMAGE FORMING MEMBER FOR ELECTROPHOTOGRAPHY

This application is a continuation of application Ser. No. 102,791 filed Sept. 24, 1987; which is a continuation of application Ser. No. 939,283, filed Dec. 3, 1986; which is a continuation of application Ser. No. 840,975, filed Mar. 13, 1986; which is a continuation of application Ser. No. 749,117, filed June 26, 1985; which is a continuation of application Ser. No. 647,869, filed Sept. 5, 1984; which is a continuation of application Ser. No. 571,147, filed Jan. 17, 1984; which is a continuation of Ser. No. 367,024, filed Apr. 9, 1982; which is a continuation of Ser. No. 199,266, filed Oct. 21, 1980; all now abandoned.

BACKGROUND OF THE INVENTION

1. Field of the Invention

This invention relates to an image forming member for electrophotography used for forming images by utilizing electromagnetic waves such as light (the light broadly means ultraviolet ray, visible ray, infrared ray, X-ray, $\gamma$-ray and the like).

2. Description of the Prior Art

Heretofore, as photoconductive materials for forming photoconductive layers of electrophotographic image forming members, there have been generally used inorganic photoconductive materials such as Se, CdS, ZnO and the like, and organic photoconductive materials (OPC) such as poly-N-vinylcarbazole (PVK), trinitrofluorenone and the like.

However, the electrophotographic image forming members has still various problems to be solved and therefore, they are now used for electrophotographic image forming processes only under relaxed or compromised operation conditions.

Apart from above, electrophotographic image forming members using a photoconductive layer composed of hydrogenated amorphous silicon (hereinafter referred to as "a—Si:H") have been recently proposed by, for example, German Laid-open (OLS) Nos. 2746967 and 2855718.

The electrophotographic image forming members provided with an a—Si:H photoconductive layer have many advantages over the prior art electrophotographic image forming members. That is, photoconductive layers of any conductive polarity, p-type or n-type, can be produced depending upon the preparation conditions despite amorphous form, and the material does not cause undesirable pollutions, and moreover, the electrophotographic image forming members are of high abrasion resistance due to the high surface hardness, excellent resistance to developing agent, high heat resistance, excellent cleaning propery, high humidity resistance and thus, have good electrophotographic properties.

Though the a—Si:H type electrophotographic image forming members have such many advantages as above, the members still have room for improvement such as photosensitivity at the practical light amount region, gamma value, and dark resistivity.

SUMMARY OF THE INVENTION

An object of the present invention is to provide an a—Si:H type electrophotographic image forming member free from the above-mentioned disadvantages.

Another object of the present invention is to provide an electrophotographic image forming member capable of producing sharply and clearly half-tone, affording high resolution and high quality of image.

A further object of the present invention is to provide an electrophotographic image forming member having improved photosensitivity at the practical light amount region, improved gamma value and improved dark resistivity.

According to the present invention, there is provided an electrophotographic image forming member which comprises a substrate and a photoconductive layer overlying the substrate and composed of a hydrogenated amorphous silicon containing 0.001–1000 atomic ppm of carbon as an impurity based on silicon.

DESCRIPTION OF THE PREFERRED EMBODIMENTS

Figure 1:
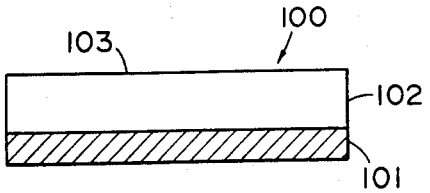
FIGS. 1, 2 and 3 are diagrammatical cross sectional views of representative embodiments of the electrophotographic image forming member according to the present invention.

Referring to FIG. 1, an electrophotographic image forming member 100 is composed of a substrate 101 and a photoconductive layer 102 which has a free surface 103 where images are formed. Photoconductive layer 102 is composed a hydrogenated amorphous silicon containing 0.001–1000 atomic ppm of carbon as an impurity based on silicon (hereinafter called "a-semiconductor").

When photoconductive layer 102 is made of a-semiconductor, the gamma value is almost 1 and the dark resistivity remarkably increases and further, the photosensitivity at the practical light amount region can be increased. The electrophotographic image forming member comprising a photoconductive layer of a-semiconductor has better electrophotographic characteristics than conventional Se series electrophotographic image forming members have.

According to the present invention, the photoconductive layer is doped with carbon as an impurity. Carbon may be distributed uniformly in the whole region of the photoconductive layer or may be distributed only in a particular layer region in the direction of thickness of the layer depending upon the type of the electrophotographic process and the electrophotographic characteristics required.

For example, in case of an electrophotographic image forming member 100 having a layer structure as illustrated in FIG. 1, only the surface layer region of the image forming surface of photoconductive layer 102 may be doped with carbon, or the whole body of the photoconductive layer 102 may be uniformly doped with carbon. Further, alternatively, the photoconductive layer may be doped with carbon in such a way that the concentration of carbon changes continuously or discontinuously in the direction of thickness.

Further, when doping is varied in the direction of thickness, two or more carbon-doped layers may be separately formed.

In order to produce a photoconductive layer by using the above mentioned a-semiconductor, for example, to produce photoconductive layer 102 by glow discharging, a gas of carbon compound is introduced into a deposition chamber together with a row material gas capable of forming a hydrogenated amorphous silicon (a—Si:H) (The pressure inside of the deposition chamber can be reduced).

Glow discharging is effected in the deposition chamber to form a photoconductive layer 102. For example, when photoconductive layer 102 is formed by sputtering, the sputtering may be conducted in a gaseous atmosphere for introducing hydrogen by using a target composed of (Si+C) at an optional ratio for sputtering or using both an Si wafer target and a carbon wafer target, or by introducing gas of a carbon compound, if desired, together with a gas for sputtering such as argon and the like, into a deposition chamber and using an Si target.

According to the present invention, there may be used most carbon compunds which do not introduce impurities unnecessary for a photoconductive layer and can be contained in a form of carbon as an effective impurity.

As such carbon compounds, carbon compounds which are gases at room temperature are preferable and effective. Representative carbon compounds are saturated hydrocarbons of $C_1$–$C_4$, ethylenic hydrocarbons of $C_1$–$C_4$ and acetylenic hydrocarbons of $C_2$–$C_3$.

More particularly, there may be used saturated hydrocarbons such as methane, ethane, propane, n-butane and the like, ethylenic hydrocarbons such as ethylene, propylene, butene-1, butene-2, isobutylene and the like, and acetylenic hydrocarbons such as acetylene, methyl acetylene and the like.

According to the present invention, the amount of carbon contained in the photoconductive layer affects characteristics of the photoconductive layer to a great extent, and is 0.001–1000 atomic ppm, preferably 0.01–100 atomic ppm, and more preferably 0.1–10 atomic ppm based on silicon.

The photoconductive layer of the present invention may be composed of one of the following types of a-semiconductor or may be composed of at least two of the following types of a-semiconductor such that at least two layers different from one another in point of semiconductor type are bonded.

(i) n-type

One donor is contained, or both donor and acceptor are contained and the concentration of the donor (Na) is higher than that of the acceptor.

(ii) p-type

Only acceptor is contained, or both donor and acceptor are contained and the concentration of the acceptor (Na) is higher than that of the donor.

(iii) i-type $$Na \approx Nd \approx O \text{ or } Na \approx Nd$$

Photoconductive layers of the electrophotographic image forming member according to the present invention composed of a-semiconductors of (i), (ii) and (iii) types as above may be prepared by doping the a-semiconductors with a controlled amount of n-type impurity, p-type impurity and both impurities, respectively, upon forming the photoconductive layer by glow discharging, reactive sputtering or the like.

The present inventors have found that a-semiconductor layers ranging from stronger n-type (or stronger p-type) to weaker n-type (or weaker p-type) can be produced by controlling the concentration of impurities in the range of $10^{15}$–$10^{19}$ $cm^{-3}$.

The a-semiconductor layer of one of (i)-(iii) types may be produced by glow discharging, sputtering, ion plating or the like.

The process for preparing the a-semiconductor may be appropriately selected depending upon production conditions, capital investment, production scale, desired electrophotographic characteristics and the like. Glow discharging process is one of the preferred processes since controlling the producing an image forming member of derised electrophotographic characteristics is relatively easy and moreover, impurities of Group III or V can be introduced in a substituted form upon introducing such impurity into an a-semiconductor layer to control to any of the types (i), (ii) and (iii).

According to the present invention, the amount of hydrogen contained in the photoconductive layer is usually 1–40 atomic %, preferably 5–30 atomic % based on silicon for practical use.

Hydrogen can be incorporated in the photoconductive layer in the following manners. For example, when glow discharging is adopted, the starting material for forming the photoconductive layer is a hydrogenated silicon such as $SiH_4$, $Si_2H_6$, $Si_3H_8$ and the like and therefore, upon decomposition of the hydrogenated silicon to form the photoconductive layer the released hydrogen is automatically contained in the photoconductive layer. For the purpose of more effectively incorporating hydrogen in the layer, hydrogen gas may be introduced into the apparatus where glow discharging is conducted, upon forming the photoconductive layer.

When a sputtering method is employed, hydrogen gas may be introduced upon conducting sputtering in a atmosphere of an inert gas such as Ar and the like or a mixture of such inert gas and other gas by using an Si wafer or an Si wafer containing carbon. Alternatively, a hydrogenated silicon gas such as $SiH_4$, $Si_2H_6$, $Si_3H_8$ and the like may be introduced or $B_2H_6$ gas, $PH_3$ gas and the like may be introduced with another purpose, that is, doping with an impurity.

The amounts of H and C to be contained in the a-semiconductor of the present invention may be controlled by adjusting temperature of a substrate for deposition, amount of starting materials introduced into the production apparatus so as to incorporate H and C, and/or plasma density. Alternatively, after forming the photoconductive layer, the layer may be exposed to an activated hydrogen atmosphere, an activated gas atmosphere containing carbon, or an activated gas atmosphere containing hydrogen and carbon.

Further, the photoconductive layer may be subjected to a heat treatment at a temperature lower than the crystallizing temperature under vacuum, or in air, hydrogen, or a gaseous atmosphere containing carbon.

In particular, such heat treatment is an effective means for improving dark resistivity of the photoconductive layer. Alternatively, the dark resistivity may be effectively improved by irradiating a light of high intensity such as laser.

The a-semiconductor of p-type can be produced by doping with an element of Group III A of the Periodic Table such as B, Al, Ga, In, Tl and the like, and that of n-type can be produced by doping with an element of Group V A of the Periodic Table such as N, P, As, Sb, Bi and the like. It is also possible to produce the n-type by doping with Li and the like utilizing heat diffusion or ion implantation.

Amount of the above mentioned impurities for doping the a-semiconductor may be optionally determined depending upon the desired electrical and optical characteristics. In case of an impurity of Group III A of the Periodic Table, the amount is usually $10^{-6}$–$10^{-3}$ atomic %, preferably $10^{-5}$–$10^{-4}$ atomic %, and in case of an impurity of Group V A of the Periodic Table, the amount is usually $10^{-8}$–$10^{-3}$ atomic %, preferably $10^{8}$–$10^{-4}$ atomic %.

Thickness of the photoconductive layer varies depending upon the desired electrophotographic characteristics and use conditions, for example, whether flexibility is required, and it is usually 5–80 microns, preferably 10–70 microns, more preferably 10–50 microns.

In case of an electrophotographic image forming member as shown in FIG. 1 in which photoconductive layer 102 has a free surface 103 and a charging treatment for forming electrostatic images is applied for forming electrostatic images, it is preferable to form a barrier layer capable of preventing carriers from entering from the substrate 101 side upon charging for forming electrostatic images between photoconductive layer 102 and substrate 101. Materials for such a barrier layer may be appropriately selected depending upon type of the substrate and electrical characteristics of the photoconductive layer. Examples of the materials are inorganic insulating compounds such as $Al_2O_3$, SiO, $SiO_2$ and the like, organic insulating compounds such as polyethylene, polycarbonate, polyurethane, polyparaxylylene and the like and metals such as Au, Ir, Pt, Rh, Pd, Mo and the like.

Substrate 101 may be conductive or insulative. As a conductive substrate, there may be used Al, Cr, Mo, Au, Ir, Nb, Te, V, Ti, Pt, Pd, alloys thereof and stainless steels. As an insulating substrate, there may be used a film or sheet of synthetic resins such as polyester, polyethylene, polycarbonate, cellulose triacetate, polypropylene, polyvinyl chloride, polyvinylidene chloride, polystyrene, polyamide and the like, glass, ceramic and paper. It is preferable that at least one surface of the insulating substrate is conductivized.

For example, a surface of glass is conductivized with $In_2O_3$, $SnO_2$, Al, Au or the like, and a synthetic resin such as polyester film and the like is treated by vacuum vapor deposition, electron beam deposition, sputtering or the like using a metal such as Al, Ag, Pb, Zn, Ni, Au, Cr, Mo, Ir, Nb, Ta, V, Ti, Pt or the like, or the metal is laminated to the film to conductivize the surface.

As a form of the substrate, there may be in an optional form such as cylinder, belt, plate and the like, and in case of continuous high speed copying, the form is preferably endless belt or cylinder.

Thickness of the substrate may be optionally selected as far as a desired image forming member is formed. When the image forming member is required to be flexible, the thickness is made as thin as possible provided that functions of a substrate can be exhibited. Taking into consideration various points of manufacturing, handling, mechanical strength and the like, the thickness is usually thicker than 10 microns.

Figure 2:
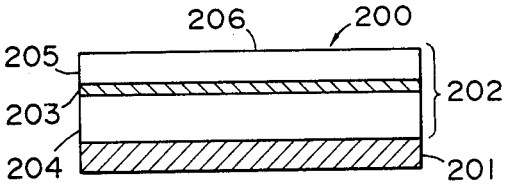

Referring to FIG. 2, an electrophotographic image forming member 200 is composed of a support 201 and a photoconductive layer 202, and the photoconductive layer 202 has a free surface 206 where images are formed and contains a depletion layer 203.

The depletion layer 203 in the photoconductive layer 202 can be formed by selecting at least two a-semiconductors of the above mentioned types and contacting the a-semiconductors of different types with each other to form layers.

For example, depletion layer 203 is produced as a junction portion between an i-type a-semiconductor layer and a p-type a-semiconductor layer by, for example, forming firstly an i-type a-semiconductor layer in a predetermined thickness on a aubstrate 201 having surface characteristics suitable for electrophotography and then forming a p-type a-semiconductor layer on said i-type a-semiconductor layer (hereinafter, the a-semiconductor layer at the substrate 201 side with respect to the depletion layer 203 is referred to as "inside layer 204" and the a-semiconductor layer at the free surface side is referred to as "outside layer 205").

In other words, a depletion layer 203 is formed at a boundary transition region between an inside a-semiconductor layer and an outside a-semiconductor layer when a photoconductive layer 202 is formed in such a manner that different types of a-semiconductor layers are jointed.

Depletion layer 203 functions as a layer for forming movable carriers by absorbing irradiated electromagnetic waves in a step of electromagnetic wave irradiation which is one step of a process for forming electrostatic images on an electrophotographic image forming member. Depletion layer 203 behaves as an intrinsic semiconductor since free carriers are depleted at a stationary state.

Figure 3:
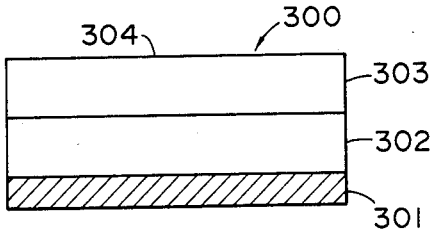

In image forming members as shown in FIG. 1 and FIG. 2, the photoconductive layer has a free surface, but a surface coating layer such as so-called protecting layer, electrically insulating layer and the like may be formed on the surface of the photoconductive layer as in some of conventional electrophotographic image forming member. FIG. 3 shows an image forming member having such a surface coating layer.

Referring to FIG. 3, an image forming member 300 is composed of a substrate 301, a photoconductive layer 302 and a surface coating layer 303 having a free surface 304. The member 300 is not essentially different from the member 100 in FIG. 1 and the member 200 in FIG. 2 except that the member 300 has surface coating layer 303.

However, required characteristics of surface coating layer 303 are different depending upon each electrophotographic process applied thereto. For example, when an electrophotographic process as disclosed in U.S. Pat. Nos. 3,666,363 and 3,734,609, so-called "NP process", is used, surface coating layer 303 is required to be electrically insulative, have a sufficient electrostatic charge retentivity when subjected to charging, and have a thickness over a certain limit. On the contrary, for example, when an electrophotographic process such as Carlson process is employed, potential at light portions after forming electrostatic images is desired to be very small and therefore, it is required that thickness of surface coating layer 303 is very thin.

Upon forming surface coating layer 303 the following conditions are take into consideration: the required electric characteristics of the layer 303 are satisfied; the layer 303 does not adversely affect photoconductive layer 302 in chemical and physical senses; electrical contact and adherability between photoconductive layer 302 and the layer 303 are good; and the layer 303 has good humidity resistance, abrasion resistance, cleaning property and the like.

Representative materials suitable for forming surface coating layer 303 are synthetic resins such as polyethylene terephthalate, polycarbonate, polypropylene, polyvinyl chloride, polyvinyliene chloride, polyvinyl alcohol, polystyrene, polyamide, polytetrafluoroethylene, polytrifluorochloroethylene, polyvinyl fluoride, polyvinylidine fluoride, propylene hexafluoride-ethylene tetrafluoride copolymer, ethylene trifluoride-vinylidene fluoride copolymer, polybutene, polyvinyl-butyral, polyurethane and the like and cellulose derivatives such as diacetate, triacetate and the like. These synthetic resins and cellulose derivatives may be made into a film and adhered onto photoconductive layer 302 or may be made into a coating solution and coated on photoconductive layer 302.

Thickness of surface coating layer 303 may be appropriately selected depending upon the material used. It is usually 0.5–70 microns. In particular, where surface coating layer 303 is used as a protecting layer as mentioned above, the thickness is usually less than 10 microns. On the contrary, where the layer 303 is used as an electrically insulating layer, the thickness is usually more than 10 microns. This value of thickness distinguishing between these two kinds of layers, 10 microns, is, however, not an absolute one, but varies depending upon materials used, electropotpgraphic processes applied and structure of the image forming member.

The present invention will be illustrated by the Examples.

EXAMPLE 1

Figure 4:
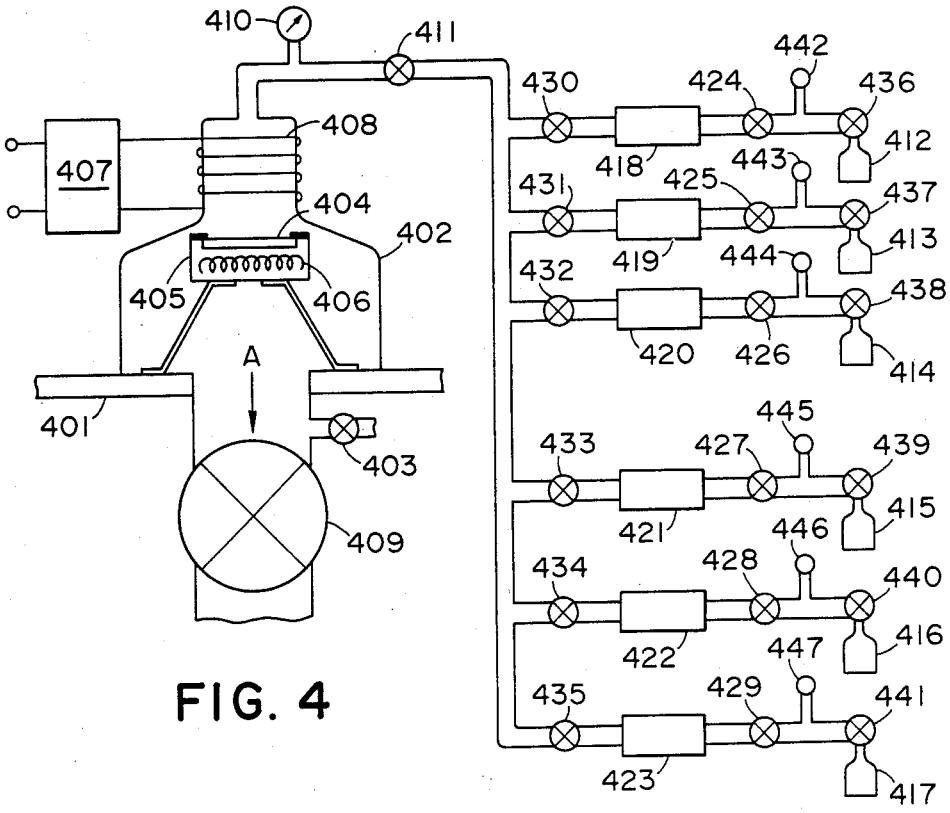
FIG. 4 shows schematically an embodiment of an apparatus for producing an electrophotographic image forming member of the present invention.

An electrophotographic image forming member was produced by the following precedure by using the apparatus shown in FIG. 4 which is provided in a fully sealed clean room.

An aluminum plate (substrate) 404 having a thickness of 0.2 mm and a diameter of 5 cm whose surface was cleaned up was fixed on a fixing member 405 which was positioned on the predetermined position in a glow discharge deposition chamber 402 which was disposed on a base plate 401. The substrate 404 was heated by a heater 406 provided in the mixing member 405 with accuracy of 0.5° C. A temperature of the substrate was measured in such a manner that the back side of the substrate 404 was brought into direct contact with a thermocouple (chromel-alumel). After it was confirmed that all valves in the apparatus were closed, a main valve 409 was fully opened. Thereby, the chamber 402 was evacuated to bring to about $5\times10^{-6}$ Torr of vacuum degree. Thereafter, an input voltage of the heater 406 was raised and adjusted with detecting the temperature of the aluminum substrate 404 in order that the temperature was stabilized at 200° C. of the constant value.

Thereafer, an auxiliary value 411, subsequently outflow valves 430 and 432, and inflow valves 424 and 426 were fully opened to evacuated flowmeters 418 and 420. After the auxiliary valve 411, and valves 430, 432, 424 and 426 were closed, a valve 436 of a bomb 412 for silane (purity: 99.999%) was opened and adjusted to bring a pressure at an outflow pressure gauge 442 to 1 kg/cm$^2$. The inflow valve 424 was gradually opened to flow silane gas into the flowmeter 418. Subsequently, the outflow valve 430 was gradually opened, and the auxiliary valve 411 was gradually opened and adjusted to bring the chamber 402 to $1\times10^{-2}$ Torr with noticing a reading of a parani gauge 410. After the inner pressure of the chamber 402 was stabilized, the main valve 409 was gradually closed to bring the indication of the pirani gauge 410 to 0.1 Torr. After it was confirmed that the inner pressure was stabilized, a valve 438 of a bomb 414 for ethylene gas (purity: 99.999%) was opened and adjusted to bring a pressure of an outflow pressure gauge to 1 kg/cm$^2$. The flowmeter 420 was set in such a manner that the flow amount of ethylene became $10^{-4}$% by volume based on the silane gas. For obtaining this condition, the inflow valve 426 and the outflow valve 432 were opened and adjusted to control the flow amount of ethylene. A switch for high frequency power source 407 was turned on the input 13.56 MHz of high frequency power to an induction coil 408 and to generate glow discharge in a chamber 408 of the coil portion (upper area of the chamber). The input power was 100 W. Under the foregoing condition, an a-semiconductor layer was grown on the substrate, and the condition was kept for 8 hours. Thereafter, the high frequency power source was turned off to stop the glow discharge. Subsequently, the pour source of the heater 406 was turned off. After the temperature of the substrate 404 became 100° C., the auxiliary valve 411, and outflow valves 430 and 432 were closed, and the main valve 409 was fully opened. After the pressure of the chamber 402 became less than $10^{-5}$ Torr, the main valve 409 was closed and a leak valve 403 was opened to bring the chamber 402 to atmospheric pressure. Then, the a-semiconductor layer formed on the substrate was taken out from the chamber. In this case, the formed a-semiconductor layer was about 16 microns in total thickness. The image forming member thus obtained was disposed in a test apparatus for charge exposure, and corona charge was applied at ⊖6 KV for 0.2 seconds, immediately a light image was projected. The light image was projected by using a tungsten lamp as a light source and an amount of light of 3 lux·second through a transparent type of test chart.

Immediately thereafter, the obtained electrostatic image was developed with a positive charged developer (containing toner and carrier) according to the cascade method, to obtain a good toner image on the surface of the member. The toner image on the member was transferred to a transfer paper by +5 KC corona charge The obtained image was sharp with a high resolution and had high density with excellent gradation.

Further, image forming members Nos. 2–6 were produced by the foregoing apparatus and in the foregoing manner except that a flow quantity of ethylene gas was varied based on a given flow quantity of silane gas. Each member was subjected to the foregoing charge exposure-developing procedure under a same condition. The obtained images were comparatively evaluated. The obtained results were shown in Table 1.

TABLE 1

| | Sample No. | | | | |
|---|---|---|---|---|---|
| | 2 | 3 | 4 | 5 | 6 |
| Flow quantity of ethylene (% by volume) | 0 | $10^{-5}$ | $10^{-4}$ | $10^{-3}$ | $10^{-2}$ |
| Evaluation of image | | | | | |
| Image density | Δ | ○ | ◎ | ◎ | ◎ |
| Sharpness | ◎ | ◎ | ◎ | ○ | Δ |

Evaluation Standard;
◎ Excellent
○ Good
Δ Acceptable for practical use

The flow quantity of ethylene gas was fixed at $10^{-4}$% by volume based on the flow quantity of silane gas, and a temperature of the aluminum substrate was varied as shown in Table 2.

Each of the obtained image forming members Nos. 7–11 was evaluated in the foregoing manner. The obtained results were shown in Table 2.

TABLE 2

| | Sample No. | | | | |
|---|---|---|---|---|---|
| | 7 | 8 | 9 | 10 | 11 |
| Temperature of substrate (°C.) | 30 | 80 | 150 | 200 | 250 |
| Evaluation of image | | | | | |
| Image density | Δ ( ) | Δ ( ) | | | |
| Sharpness | Δ ( ) | ( ) | | | |

Evaluation standard in the same as that in Table 1.

The indications in parentheses are evaluation concerning members which were treated with heat at 200° C. under vacuum ($10^{-2}$ Torr) for 1 hour. Sharpness of an image forming member which was provided with a-semiconductor layer formed at a lower substrate temperature was improved by heat-treating.

Further, image forming members Nos. 12–16 were formed under conditions that the flow quantity of ethylene gas fixed at $10^{-4}$% by volume based on the flow quantity of the silane gas, the aluminum substrate temperature was fixed at 80° C., and the input powers for glow dischare were varied. The obtained members were treated at 200° C. under vacuum ($10^{-2}$ Torr) for 1 hour to evaluate in the foregoing manner. The obtained result were shown in Table 3.

TABLE 3

| | Sample No. | | | | |
|---|---|---|---|---|---|
| | 12 | 13 | 14 | 15 | 16 |
| Discharge power (W) | 20 | 40 | 100 | 150 | 200 |
| Evaluation of image | | | | | |
| Image density | Δ | ○ | ◎ | ◎ | ○ |
| Sharpness | Δ | ○ | ◎ | ◎ | ○ |

Evaluation standard is the same as that in Table 1.

EXAMPLE 2

An aluminum substrate was disposed in the same manner as described in Example 1. Subsequently, the glow discharge deposition chamber 402 was brought to a vacuum degree of $5\times10^{-6}$ Torr and the temperature of the substrate was kept at 200° C. in the same manner as that described in Example 1. Thereafter, in the same manner as that described in Example 1, silane gas and ethylene gas ($10^{-4}$% by volume based on the silane gas) were allowed to flow, and the pressure of the chamber was adjusted to 0.1 Torr. At this time, phosphine was allowed to flow from a phosphine bomb 416 through a valve 440 at a flow quanity of 0.03% based on silane gas. An inflow valve 428 and an outflow valve 434 were adjusted at 1 kg/cm$^2$ of phosphine gas (by read of an outflow pressure gauge 446) by read of a flowmeter 422, to inject a mixture of silane gas, ethylene gas, and phosphine gas. After stabilizing the flow of the gases, the pressure of the chamber, and the temperature of the substrate at 200° C., flow discharge was started by turning on the high prequency power source 407 in the same manner as described in Example 1. Under this conditions, the glow discharge was kept for 6 hours. Thereafter the high frequency power source 407 was turned off to stop the glow discharge. Subsequently, outflow valves 430, 432 and 434 were closed, and the auxiliary valve 411 and the main valve 409 were fully opened to bring the chamber 402 to $5\times10^{-6}$Torr. Then, the auxiliary valve 411 and the main valve 409 were closed, the outflow valves 430 and 432 gradually opened, and the main valve 409 was returned to such state that silane gas and ethylene gas flow at the same state as that in the layer formation. Next, a valve 441 of a bomb 417 for diborane was opened and adjusted to bring a pressure at an outflow gauge 447 to 1 kg/cm$^2$.

An inflow valve 429 was gradually opened to introduce diborane into a flowmeter 423. An opening degree of an outflow valve 435 was fixed in such a way that a reading of the flowmeter 423 became 0.04% by volume based on the silane gas. Thus, the flow quantities of diborane, silane and ethylene were stabilized. Subsequently, the high frequency power source 407 was again turned on to start glow discharge. The glow discharge was kept for 45 minutes under these conditions, thereafter the heater 406 and the high frequency power source 407 were turned off. After the temperature of the substrate became 100° C., the auxiliary valve 411 and the outflow valves 430, 432 and 435 were closed, and the main valve 409 was fully opened to bring the chamber 402 to less than $10^{-5}$ Torr. Next, the main valve 409 was closed, and the chamber 402 was brought to atmospheric pressure by opening a leak valve 403 to take out the substrate from the chamber.

An image forming member was obtained by the foregoing procedure. The formed semiconductor layer was about 15 microns in total thickness.

The thus obtained image forming member was subjected to an image forming test by using the test apparatus for charge exposure in the same manner as described in Example 1. In case of the combination of 6 KV of corona discharge and positive charge developer, a toner image obtained on a transfer paper was very good and had a high contrast.

EXAMPLE 3

An aluminum substrate (4×4 cm) having a thickness of 0.1 mm which the surface was cleaned was disposed on a fixing member 405 provided in an apparatus shown in FIG. 4 in the same menner as described in Example 1. Subsequently, a glow discharge deposition chamber 402 and all gas inflow system were brought to $5\times10^{-6}$ Torr, and the substrate temperature was kept at 200° C. in the same manner as described in Example 1. Silane gas and ethylene gas ($10^{-4}$% by volume based on the silane gas) were introduced to the chamber 402 in the same manner as described in Example 1, and the chamber 402 was brought to 0.1 Torr.

Further, a valve 441 of a bomb 417 for diborane was opened and adjusted to bring a pressure at an outflow pressure gauge 447 to 1 kg/cm$^2$. Then, as inflow valve 429 and an outflow valve 435 were gradually opened to introduce diborane gas into the chamber at a flow quantity of 0.10% by volume based on the silane gas at a flowmeter 423. After stabilizing the flow of silane gas, ethylene gas, and diborane gas, and the temperature of the substrate at 200° C., a high frequency power source 407 was turned on to start glow discharge in the chamber 402. Under this condition, glow discharge was carried out for 15 minutes, then the outflow valve 435 for diborane gas was gradually closed and adjusted by noticing the flowmeter 423 with keeping glow discharge to bring a flow quantity of diborane to 0.03% by volume based on the silane gas.

Under this condition, glow discharge was additionally kept 8 hours. Thereafter, the high frequency power source 407 was turned off to stop the glow discharge, then the heater 406 was turned off. After the temperature of the substrate became 100° C., the auxiliary valve 411 and the outflow valves 430, 432 and 435 were closed, and the main valve 409 was fully opened to bring the chamber 402 to less than $10^{-5}$ Torr. Thereafter, the main valve 409 was closed, and a leak valve 403 was opened to bring the chamber 402 to atmospheric pressure. Then, the substrate on which a photoconductive layer was formed was taken out fom the chamber.

The obtained photoconductive layer had about 16 microns in total thickness. The aluminum surface, i.e., the back side of the thus obtained member was brought into close contact with an adhesive tape and then immersed perpendicularly into a 30% solution of polycarbonate resin in toluene. The member was drawn up at a speed of 1.5 cm/sec. so that a polycarbonate resin layer having a thickness of 15 microns was formed on the photoconductive layer. Thereafter, the adhesive tape was removed.

The obtained image forming member was fixed to an aluminum drum of an test apparatus which was made by modification of a commercial available copying machine (trade name: NP-L7, supplied by CANON K.K.) and subjected to the image forming process comprising the primary charging with ⊖7 KV, imagewise exposing simultaneous with AC charging with 6 KV, developing (with a negatively charged liquid developer), liquid-squeezing (with a roller squeezing), and transferring simultaneously with charging with ⊖5 KV. As a result, a sharp image of a high contrast was obtained on a plain paper. Even when the precess was continuously repeated, 100,000 times, the obtained images retained the initial excellent image quality.

What we claim is:

1. An electrophotographic image forming member which comprises a substrate and a photoconductive layer overlying the substrate, said photoconductive layer comprising (a) a hydrogenated amorphous silicon having from 1 to 40 atomic percent of hydrogen based on silicon and (b) from 0.001–100 atomic ppm of carbon as an impurity based on silicon.

2. An electrophotographic image forming member which comprises a substrate, a barrier layer overlying the substrate and a photoconductive layer overlying the barrier layer, said photoconductive layer comprising (a) hydrogenated amorphous silicon and (b) from 0.001–100 atomic ppm of carbon as an impurity based on silicon.

3. An electrophotographic image forming member of claim 1 in which the photoconductive layer contains $10^{-6}$–$10^{-3}$ atomic percent of an element of Group IIIA of the Periodic Table as an impurity based on silicon.

4. The electrophotographic image forming member of claim 1 in which the photoconductive layer contains $10^{-8}$–$10^{-3}$ atomic percent of an element of Group VA of the Periodic Table as an impurity based on silicon.

5. The electrophotographic image forming member of claim 2 in which the photoconductive layer contains 1–40 atomic percent of hydrogen based on silicon.

6. The electrophotographic image forming member of claim 2 in which the photoconductive layer contains $10^{-6}$–$10^{-3}$ atomic percent of an element of Group IIIA of the Periodic Table as an impurity based on silicon.

7. The electrophotographic image forming member of claim 2 in which the photoconductive layer contains $10^{-8}$–$10^{-3}$ atomic percent of an element of Group VA of the Periodic Table as an impurity based on silicon.

* * * * *

UNITED STATES PATENT AND TRADEMARK OFFICE

CERTIFICATE OF CORRECTION

PATENT NO. : 4,818,656

DATED : April 4, 1989

INVENTOR(S) : TADAJI FUKUDA, ET AL.

It is certified that error appears in the above-identified patent and that said Letters Patent is hereby corrected as shown below:

COLUMN 2

Line 16, "cross sectional" should read --cross-sectional--.
Line 30, "composed" should read --composed of--.
Line 65, "above mentioned" should read --above-mentioned--.
Line 68, "row" should read --now--.

COLUMN 3

Line 15, "compunds" should read --compounds--.
Line 45, "donor (Na)" should read --donor (Nd)--.
Line 44, "One" should read -- Only --.

COLUMN 4

Line 9, "the" should read --for--.
Line 10, "derised" should read --desired--.
Line 32, "a" should read --an--.
Line 67, "above mentioned" should read --above-mentioned--.

COLUMN 5

Line 66, "above mentioned" should read --above-mentioned--.

UNITED STATES PATENT AND TRADEMARK OFFICE

CERTIFICATE OF CORRECTION

PATENT NO. : 4,818,656

DATED : April 4, 1989

INVENTOR(S) : TADAJI FUKUDA, ET AL.

It is certified that error appears in the above-identified patent and that said Letters Patent is hereby corrected as shown below:

COLUMN 6

Line 5, "substrate 201" should read --substrate 201--.
Line 57, "take" should read --taken--.

COLUMN 7

Line 22, "electropotpgraphic" should read --electrophotographic--.
Line 29, "precedure" should read --procedure--.
Line 38, "mixing number 405" should read --fixing number 405--.
Line 53, "evacuated" should read --evacuate--.
Line 63, "parani gauge 410." should read --pirani gauge 410.--.

COLUMN 8

Line 8, "the" should read --to--.
Line 10, "chamber 408 of" should read --chamber 402 at--.
Line 16, "pour source" should read --power source--.
Line 38, "charge" should read --charge.--.
Line 48, "were" should read --are--.
Line 68, "were" should read --are--.

UNITED STATES PATENT AND TRADEMARK OFFICE

CERTIFICATE OF CORRECTION

PATENT NO. : 4,818,656

DATED : April 4, 1989

INVENTOR(S) : TADAJI FUKUDA, ET AL.

It is certified that error appears in the above-identified patent and that said Letters Patent is hereby corrected as shown below:

COLUMN 9

Table 2, "Evaluation of image

| | | |
|---|---|---|
| Image density | Δ( ) | Δ( ) |
| Sharpness | Δ( ) | ( ) " |

should read

--Evaluation of image

| | | | | | | |
|---|---|---|---|---|---|---|
| Image density | Δ(◎) | Δ(◎) | ◎ | ◎ | ○ | |
| Sharpness | Δ(◎) | ○(◎) | ◎ | ◎ | ○ | --. |

COLUMN 9

Line 10, "in" (first occurrence) should read --is--.
Line 11, "evaluation" should read --evaluations--.
Line 22, "dischare" should read --discharge--.
Line 25, "result were" should read --results are--.
Line 56, "flow discharge" should read --glow discharge--.
Line 57, "high prequency power source 407" should read --high frequency power source 407--.
Line 58, "this" should read --these--.
Line 60, "ter" should read --ter,--.

UNITED STATES PATENT AND TRADEMARK OFFICE

CERTIFICATE OF CORRECTION

PATENT NO. : 4,818,656

DATED : April 4, 1989

INVENTOR(S) : TADAJI FUKUDA, ET AL.

It is certified that error appears in the above-identified patent and that said Letters Patent is hereby corrected as shown below:

COLUMN 10

Line 37, "menner" should read --manner--.
Line 39, "system" should read --systems--.
Line 48, "as" should read --an--.

COLUMN 11

Line 18, "an" should read --a--.
Line 19, "commercial" should read --commercially--.
Line 28, "precess" should read --process-.

COLUMN 12

Line 2, "a hydrogenated" should read --hydrogenated--.
Line 13, "An" should read --The--.

Signed and Sealed this

Twenty-fourth Day of October, 1989

*Attest:*

DONALD J. QUIGG

*Attesting Officer*

*Commissioner of Patents and Trademarks*